US009711082B2

(12) United States Patent
Toyomura et al.

(10) Patent No.: US 9,711,082 B2
(45) Date of Patent: Jul. 18, 2017

(54) DISPLAY APPARATUS AND DISPLAY DRIVE METHOD

(75) Inventors: Naobumi Toyomura, Kanagawa (JP); Katsuhide Uchino, Kanagawa (JP)

(73) Assignee: JOLED Inc., Tokyo (JP)

( * ) Notice: Subject to any disclaimer, the term of this patent is extended or adjusted under 35 U.S.C. 154(b) by 1522 days.

(21) Appl. No.: 12/923,878

(22) Filed: Oct. 13, 2010

(65) Prior Publication Data

US 2011/0128276 A1 Jun. 2, 2011

(30) Foreign Application Priority Data

Dec. 1, 2009 (JP) ..... 2009-273236

(51) Int. Cl.
*G09G 3/3233* (2016.01)
*G09G 3/3266* (2016.01)
*G09G 3/3291* (2016.01)

(52) U.S. Cl.
CPC ..... *G09G 3/3233* (2013.01); *G09G 3/3266* (2013.01); *G09G 3/3291* (2013.01); *G09G 2300/0819* (2013.01)

(58) Field of Classification Search
CPC .... G09G 3/3208; G09G 3/3225; G09G 3/325; G09G 3/3241; G09G 3/3233; G09G 3/3291; G09G 3/3266; G09G 2300/0814
USPC ..... 345/204, 211, 212, 214–215, 76–79, 345/82–83
See application file for complete search history.

(56) References Cited

U.S. PATENT DOCUMENTS 8,054,298 B2 * 11/2011 Asano ..... G09G 3/3233 345/173
8,860,636 B2 * 10/2014 Nathan ..... G09G 3/3233 313/463
9,370,075 B2 * 6/2016 Chaji ..... H05B 37/02
2004/0046164 A1 3/2004 Kobayashi et al.
2005/0206590 A1 9/2005 Sasaki et al.
2005/0269959 A1 * 12/2005 Uchino et al. ..... 315/169.3
2006/0125740 A1 * 6/2006 Shirasaki et al. ..... 345/77
(Continued)

FOREIGN PATENT DOCUMENTS

JP 2003-255856 9/2003
JP 2003-271095 A 9/2003
JP 2007-133282 A 5/2007

*Primary Examiner* — Jonathan Horner
(74) *Attorney, Agent, or Firm* — Michael Best & Friedrich LLP

(57) ABSTRACT

A display apparatus includes: a pixel array including pixel circuits arranged in a matrix form, in which each pixel circuit has a light-emitting device, a drive transistor applying a current corresponding to a gate-source voltage to the light-emitting device, a sampling transistor inputting a voltage supplied from a signal line to a gate of the drive transistor, and a storage capacitor connected between the gate and source of the drive transistor so as to store a threshold voltage of the drive transistor and an input video signal voltage; a signal selector that supplies a reference voltage and the video signal voltage to signal lines arranged in columns on the pixel array in horizontal periods corresponding to the number of horizontal lines in one unit when the horizontal lines of the respective pixel circuits of the pixel array are grouped as one unit; and a scanner that applies a pulse to control lines arranged in rows on the pixel array so as to control the sampling transistor of the pixel circuit.

8 Claims, 10 Drawing Sheets

(56) References Cited

U.S. PATENT DOCUMENTS

| | | | | |
|---|---|---|---|---|
| 2006/0208975 | A1* | 9/2006 | Ono | 345/76 |
| 2006/0221015 | A1* | 10/2006 | Shirasaki et al. | 345/77 |
| 2006/0256058 | A1* | 11/2006 | Asano et al. | 345/92 |
| 2007/0018078 | A1* | 1/2007 | Miyazawa | 250/214.1 |
| 2008/0001861 | A1* | 1/2008 | Asano et al. | 345/77 |
| 2008/0036708 | A1* | 2/2008 | Shirasaki et al. | 345/76 |
| 2008/0111773 | A1* | 5/2008 | Tsuge | 345/76 |
| 2008/0111812 | A1* | 5/2008 | Shirasaki et al. | 345/212 |
| 2008/0158110 | A1* | 7/2008 | Iida et al. | 345/76 |
| 2008/0198111 | A1* | 8/2008 | Yamashita et al. | 345/87 |
| 2009/0189924 | A1* | 7/2009 | Ogura | 345/690 |
| 2009/0244055 | A1* | 10/2009 | Asano et al. | 345/214 |
| 2009/0251493 | A1 | 10/2009 | Uchino et al. | |

* cited by examiner

DISPLAY APPARATUS AND DISPLAY DRIVE METHOD

BACKGROUND OF THE INVENTION

1. Field of the Invention

The invention relates to a display apparatus including a pixel array in which pixel circuits are arranged in a matrix form and a display drive method thereof, and relates to, for example, a display apparatus in which an organic electroluminescence device (organic EL device) is used as a light-emitting device.

2. Description of the Related Art

An image display apparatus in which an organic EL device is used in a pixel has been developed, for example as illustrated in JP-A-2003-255856 and JP-A-2003-271095. Since the organic EL device is a self-luminous device, it has advantages such that visibility of images is higher than, for example, a liquid crystal display, a backlight is not necessary, and a response speed is high. The luminance level (gray level) of each light-emitting device can be controlled by a value of current flowing thereto (so-called current-control type).

In an organic EL display, the drive method thereof is classified into a passive matrix method and an active matrix method similarly to the liquid crystal display. A display apparatus using the former driving method has a simple structure, but has a problem that it is difficult to realize a large high-definition display. For this reason, the active-matrix type display apparatus is being developed vigorously at present. In this driving method, a current flowing to a light-emitting device in each pixel circuit is controlled by an active device (typically, a thin film transistor (TFT)) provided in the pixel circuit.

SUMMARY OF THE INVENTION

As the pixel circuit configuration using the organic EL device, there is a strong demand for improvement of display quality as well as realization of higher luminance, higher definition and a higher frame rate (higher operation frequency) by eliminating luminance unevenness in each pixel and the like. There is also progress in the development of larger display panels.

From these perspectives, various configurations are being taken into consideration. Various pixel circuit configurations and operations are proposed, and for example, JP-A-2007-133282 discloses a pixel circuit in which luminance unevenness in each pixel is eliminated by cancelling variations in a threshold voltage or mobility of a drive transistor in each pixel.

It is desirable to realize a pixel circuit operation suitable for realizing higher operation frequency and a larger display panel as the display apparatus using the organic EL device.

According to an embodiment of the invention, there is provided a display apparatus including: a pixel array including pixel circuits arranged in a matrix form, in which each pixel circuit has a light-emitting device, a drive transistor applying a current corresponding to a gate-source voltage to the light-emitting device, a sampling transistor inputting a voltage supplied from a signal line to a gate of the drive transistor when the sampling transistor is brought into a conduction state, and a storage capacitor connected between the gate and source of the drive transistor so as to store a threshold voltage of the drive transistor and an input video signal voltage; a signal selector that supplies a reference voltage and the video signal voltage to signal lines arranged in columns on the pixel array in a plurality of horizontal periods corresponding to the number of horizontal lines in one unit when the plurality of horizontal lines of the respective pixel circuits of the pixel array are grouped as one unit; and a scanner that applies a pulse to control lines arranged in rows on the pixel array so as to control the sampling transistor of the pixel circuit. The scanner is configured to input the reference voltage to the respective pixel circuits so that a threshold correction operation starts simultaneously within one emission cycle period in the respective pixel circuits, input the video signal voltage sequentially to each pixel circuit in the unit after an ending time point of the threshold correction operation, and output a pulse that causes the ending time point of the threshold correction operation to occur at different times in each pixel circuit so that periods from the ending time points of the threshold correction operation in the respective pixel circuits to the start of the inputting of the video signal voltage are the same.

The scanner may cause the threshold correction operation to be performed in several rounds within one emission cycle period in each pixel circuit and outputs the pulse that causes the ending time point of only a final round of the threshold correction operation among the several rounds of the threshold correction operation to occur at different times in each pixel circuit. The scanner may output the pulse that causes the ending time points of other rounds of the threshold correction operation other than the final round of the threshold correction operation among the several rounds of the threshold correction operation to occur simultaneously in each pixel circuit.

According to another embodiment of the invention, there is provided a display drive method in which the scanner is allowed to input the reference voltage to the respective pixel circuits so that a threshold correction operation starts simultaneously within one emission cycle period in the respective pixel circuits, input the video signal voltage sequentially to each pixel circuit in the unit after an ending time point of the threshold correction operation, and output a pulse that causes the ending time point of the threshold correction operation to occur at different times in each pixel circuit so that periods from the ending time points of the threshold correction operation in the respective pixel circuits to the start of the inputting of the video signal voltage are the same.

According to still another embodiment of the invention, there is provided a display apparatus including: a scanner; and a pixel array that performs a threshold correction operation and a video signal write operation on pixel circuits in response to a pulse output from the scanner. The scanner is configured to cause the threshold correction operation to start simultaneously in each pixel circuit on plural rows, cause the video signal write operation to start sequentially in each pixel circuit on the plural rows, and output a pulse so that a period from the end of the threshold correction operation to the start of the video signal write operation is the same in each pixel circuit on the plural rows.

According to yet another embodiment of the invention, there is provided a display apparatus including: a scanner; a signal line that supplies a reference potential and a video signal potential; and a pixel array that inputs the reference potential and the video signal potential from the signal line to pixel circuits in response to a pulse output from the scanner. The scanner is configured to cause the reference potential to be input simultaneously in each pixel circuit on plural rows, cause the video signal potential to be input sequentially in each pixel circuit on the plural rows, and output a pulse so that a period from the end of the inputting of the reference potential to the start of the inputting of the video signal potential is the same in each pixel circuit on the plural rows.

In the embodiments of the invention, an STC (simultaneous threshold cancel) driving method is used in which first, a plurality of horizontal lines is grouped as one unit so that a threshold correction operation is performed simultaneously in the respective pixel circuits in the same unit. For example, when three horizontal lines are grouped as one unit, pixels on the three lines are simultaneously subjected to the threshold correction operation. By this STC driving, a long threshold correction period can be secured even when the frame rate is high.

In this case, the signal selector supplies the threshold correction reference voltage to the signal lines so that the gate of the drive transistor is maintained at the threshold correction reference voltage during the threshold correction operation. Moreover, the signal selector sequentially supplies the video signal voltage for the pixel circuits to the signal lines so that the video signal voltage is sequentially applied to the respective pixel circuits (drive transistors) in the unit. For example, when three lines are grouped as one unit, a threshold correction reference voltage, a video signal voltage for pixel circuits on the first line in the unit, a video signal voltage for pixel circuits on the second line, and a video signal voltage for pixel circuits on the third line are supplied in three horizontal periods.

In this case, since the threshold correction operation is simultaneously performed in each pixel circuit on the unit, the waiting terms from the completion of the threshold correction operation to the writing of the video signal voltage are different.

Therefore, in the embodiments of the invention, the ending time points of the final threshold correction operation in one emission cycle period are made to be different in each pixel circuit in the unit. That is, the ending time points of the final threshold correction operation for the respective pixel circuits in the unit are set so that the waiting terms from the ending time points of the threshold correction operation in the respective pixel circuits to the start time points of the inputting of the video signal voltage are the same.

According to the STC driving, the waiting terms from the completion of the threshold correction operation to the start of the writing of the video signal voltage are different in each pixel circuit in the unit. In contrast, according to the embodiments of the invention, the ending time points of the final threshold correction operations are set so that the waiting terms from the ending time points of the threshold correction operation in the respective pixel circuits to the start time points of the inputting of the video signal voltage are the same. Since the waiting terms are the same, the influence of the leak current will be the same in each pixel circuit in the unit. Therefore, it is possible to prevent the variations in the luminance levels of the respective pixel circuits resulting from the leak current during the waiting terms.

That is, it is possible to prevent shading in the same unit which occurs with the STC driving suitable for the higher frame rate due to the leak current flowing between the drain and source of the drive transistor, thus realizing a display apparatus providing good uniformity (uniformness).

DESCRIPTION OF THE PREFERRED EMBODIMENTS

Hereinafter, preferred embodiments of the invention will be described in the following order:

1. Configuration of Display Apparatus and Pixel Circuit
2. Pixel Circuit Operation Considered in the Process of Achieving the Invention: Divided Threshold Correction
3. Pixel Circuit Operation Considered in the Process of Achieving the Invention: STC Driving
4. Pixel Circuit Operation of Embodiment

[1. Configuration of Display Apparatus and Pixel Circuit]

Figure 1:
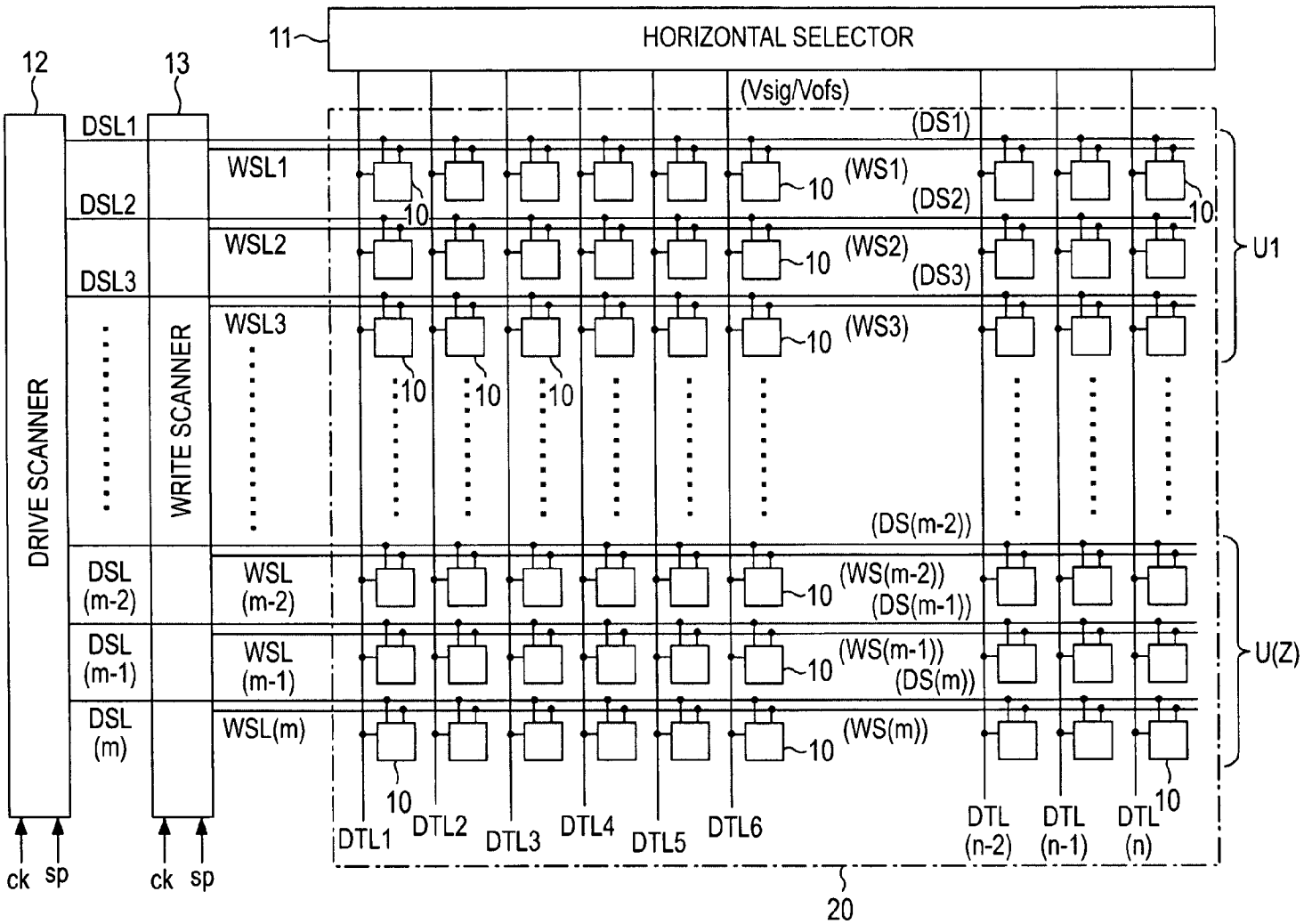
FIG. 1 is a diagram illustrating the configuration of a display apparatus according to an embodiment of the invention.

FIG. 1 illustrates the configuration of an organic EL display apparatus according to an embodiment.

The organic EL display apparatus includes a plurality of pixel circuits 10 in which organic EL devices are used as light-emitting devices, and in which light emission is driven in accordance with an active matrix method.

As illustrated in FIG. 1, the organic EL display apparatus includes a pixel array 20 in which a number of pixel circuits 10 are arranged in a matrix form in both row and column directions (m rows by n columns). Each of the pixel circuits 10 serves as a light-emitting pixel of any one of the colors R (red), G (green), and B (blue). The pixel circuits 10 of the respective colors are arranged in accordance with a predetermined rule, whereby a color display apparatus is formed.

As a configuration for driving the light emission of the respective pixel circuits 10, a horizontal selector 11, a drive scanner 12, and a write scanner 13 are provided.

Moreover, signal lines DTL1, DTL2, . . . , and DTL(n) which are selected by the horizontal selector 11 and which supply voltage corresponding to a signal value (gray level value) of a luminance signal serving as display data to the pixel circuits 10 are arranged in the column direction on the pixel array 20. The signal lines DTL1, DTL2, . . . , and DTL(n) are arranged by the number of columns (n columns) of the pixel circuits 10 which are arranged in the matrix form in the pixel array 20.

Furthermore, write control lines WSL1, WSL2, . . . , and WSL(m) and power control lines DSL1, DSL2, . . . , and DSL(m) are arranged in the row direction on the pixel array 20. These write control lines WSL and power control lines DSL are arranged by the number of rows (m rows) of the pixel circuits 10 which are arranged in the matrix form in the pixel array 20.

The write control lines WSL (WSL1 to WSL(m)) are driven by the write scanner 13.

The write scanner 13 supplies scan pulses WS (WS1, WS2, . . . , and WS(m)) sequentially to the respective write control lines WSL1 to WSL (m) arranged in rows at the set predetermined timings so as to line-sequentially scan each row of the pixel circuits 10.

The power control lines DSL (DSL1 to DSL(m)) are driven by the drive scanner 12. The drive scanner 12 supplies power pulses DS (DS1, DS2, . . . , and DS(m)) to the respective power control lines DSL1 to DSL (m) which are arranged in rows in time with the line-sequential scanning by the write scanner 13. The power pulses DS (DS1, DS2, . . . , and DS(m)) have a pulse voltage which changes between two values of a drive voltage Vcc and an initial voltage Vini.

Moreover, the drive scanner 12 and the write scanner 13 set the timings of the scan pulses WS and power pulses DS based on a clock ck and a start pulse sp.

The horizontal selector 11 supplies a signal line voltage, which serves as an input signal to the pixel circuits 10, to the signal lines DTL1, DTL2, . . . , and DTL(n) which are arranged in the column direction in time with the line-sequential scanning by the write scanner 13.

In the present embodiment, the horizontal selector 11 supplies a threshold correction reference voltage Vofs and a video signal voltage Vsig to the respective signal lines as the signal line voltage.

In the present embodiment, light emission of pixels is driven in accordance with a STC driving method, details of which will be described later. For example, three horizontal lines are grouped as one unit.

In them rows of horizontal lines as illustrated in FIG. 1, a light emitting operation is performed for each of the units U1 to U(z) each including three lines. Pixel circuits in the same unit are subjected to a threshold correction operation simultaneously.

In this case, although it will be described later, the horizontal selector 11 supplies a threshold correction reference voltage Vofs, a video signal voltage Vsig for the first line in the unit, a video signal voltage Vsig for the second line, and a video signal voltage Vsig for the third line to the respective signal lines within three horizontal periods as the signal line voltage.

In the display apparatus of this embodiment, the horizontal selector 11, the drive scanner 12, and the write scanner 13 are examples of a signal selector, a drive control scanner, and a write scanner in the concept of the invention, respectively.

Figure 2:
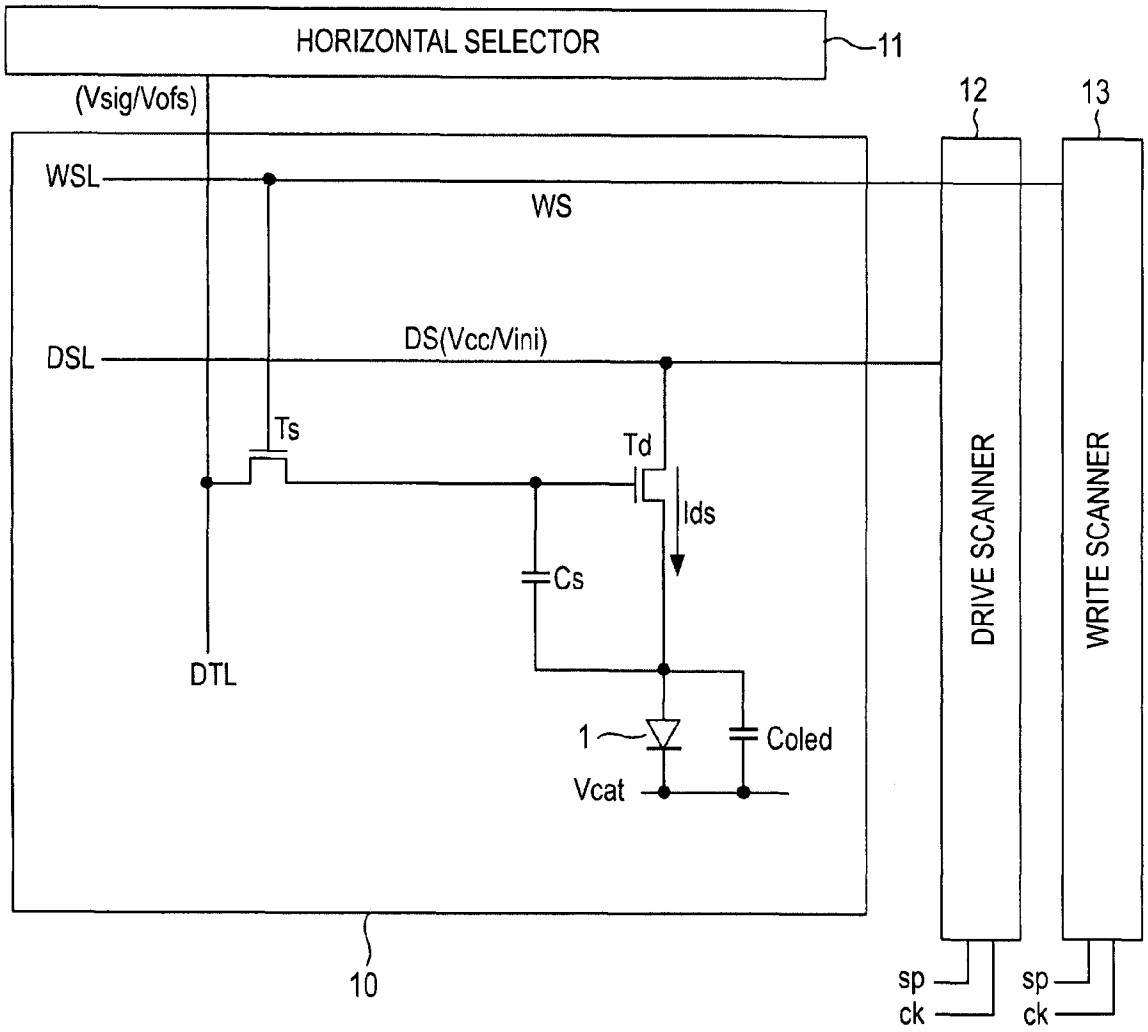
FIG. 2 is a circuit diagram of a pixel circuit of the embodiment.

FIG. 2 illustrates the configuration example of the pixel circuits 10. The pixel circuits 10 are arranged in a matrix form similarly to the pixel circuits 10 in the configuration illustrated in FIG. 1.

In FIG. 2, only one pixel circuit 10 which is disposed at one of the intersections of the signal lines DTL, the write control lines WSL, and the power control lines DSL are illustrated for the sake of simplicity.

The pixel circuit 10 includes an organic EL device 1 which is a light-emitting device, a storage capacitor Cs, a sampling transistor Ts, and an n-channel thin-film transistor (TFT) serving as a drive transistor Td. A capacitor Coled is a parasitic capacitor of the organic EL device 1.

One terminal of the storage capacitor Cs is connected to a source of the drive transistor Td, and the other terminal thereof is connected to a gate of the drive transistor Td.

The light-emitting device of the pixel circuit 10 is, for example, a diode-type organic EL device 1 including an anode and a cathode. The anode of the organic EL device 1 is connected to the source of the drive transistor Td, and the cathode thereof is connected to a predetermined wire (at the cathode potential Vcat).

One terminal of the drain and source of the sampling transistor Ts is connected to the signal line DTL, and the other terminal thereof is connected to the gate of the drive transistor Td.

The gate of the sampling transistor Ts is connected to the write control line WSL.

The drain of the drive transistor Td is connected to the power control line DSL.

Basically, light emission of the organic EL device 1 is driven in the following manner.

The sampling transistor Ts is brought into a conduction state in response to the scan pulse WS which is supplied from the write scanner 13 through the write control line WSL at the time when the video signal voltage Vsig is applied to the signal line DTL. In this way, the video signal voltage Vsig from the signal line DTL is written to the storage capacitor Cs.

The drive transistor Td allows a current Ids to flow to the organic EL device 1 in response to supply of current from the power control line DSL to which a drive potential Vcc is applied by the drive scanner 12, whereby the organic EL device 1 emits light.

At this time, the current Ids has a value corresponding to a gate-source voltage Vgs of the drive transistor Td (namely, the voltage stored in the storage capacitor Cs). The organic EL device 1 emits light at a luminance level corresponding to the current value.

That is, in the case of this pixel circuit 10, the video signal voltage Vsig from the signal line DTL is written to the storage capacitor Cs so as to change the voltage applied to the gate of the drive transistor Td. Thus, the value of current flowing to the organic EL device 1 is controlled so as to obtain an appropriate gray level for light emission.

Since the drive transistor Td is designed so as to always operate in the saturation region, the drive transistor Td serves as a constant current source having a value expressed by Expression 1 below.

$$Ids=(1/2)\cdot\mu\cdot(W/L)\cdot Cox\cdot(Vgs-Vth)^2 \quad \text{(Expression 1)}$$

In this expression, Ids is a current flowing between the drain and source of a transistor operating in the saturation region, μ is the mobility, W is a channel width, L is a channel length, Cox is a gate capacitance, and Vth is a threshold voltage of the drive transistor Td.

As is clear from Expression 1, in the saturation region, the drain current Ids is controlled by the gate-source voltage Vgs. In the drive transistor Td, since the gate-source voltage Vgs is maintained to be constant, the drive transistor Td operates as a constant current source and is able to allow the organic EL device 1 to emit light at a constant luminance level.

As described above, basically, an operation of writing a video signal value (gray level value) Vsig in the storage capacitor Cs is performed on the pixel circuit 10 in each frame period. In this way, the gate-source voltage Vgs of the drive transistor Td is determined in accordance with a display gray level.

Moreover, the drive transistor Td operates in the saturation region and thus functions as a constant current source to the organic EL device 1 and allows a current corresponding to the gate-source voltage Vgs to flow to the organic EL device 1. Thus, in each frame period, the organic EL device 1 emits light at a luminance level corresponding to a gray level value of a video signal.

[2. Pixel Circuit Operation Considered in the Process of Achieving the Invention: Divided Threshold Correction]

In this section, a pixel circuit operation considered in the process of achieving the invention will be described. This pixel circuit operation is a circuit operation which includes a threshold correction operation and a mobility correction operation for correcting uniformity deterioration due to variations in the threshold and mobility of the drive transistor Td in each pixel circuit 10. Particularly, a divided threshold correction operation in which the threshold correction operation is divided into several rounds and performed in a time-divided manner within one light emission cycle period will be described as an example of the threshold correction operation.

As for the pixel circuit operation, specifically the threshold correction operation and mobility correction operation themselves have been performed in the past, and the necessity thereof will be described briefly below.

For example, in a pixel circuit using polysilicon TFTs or the like, the threshold voltage Vth of the drive transistor Td and the mobility μ of a semiconductor thin film that forms the channel of the drive transistor Td often vary with time. Moreover, due to variations in manufacturing processes, the transistor characteristics such as the threshold voltage Vth and the mobility μ are often different from pixel to pixel.

When the threshold voltage and the mobility of the drive transistor Td are different from pixel to pixel, the value of current flowing to the drive transistor Td also varies. Therefore, even when the same video signal value (video signal voltage Vsig) is applied to the entire pixel circuits 10, the light emission luminance levels of the organic EL device 1 will be different from pixel to pixel. As a result, uniformity (uniformness) of a screen will be impaired.

From this respect, the pixel circuit operation aims to provide a function of correcting variations in the threshold voltage Vth and the mobility μ.

Figure 3:
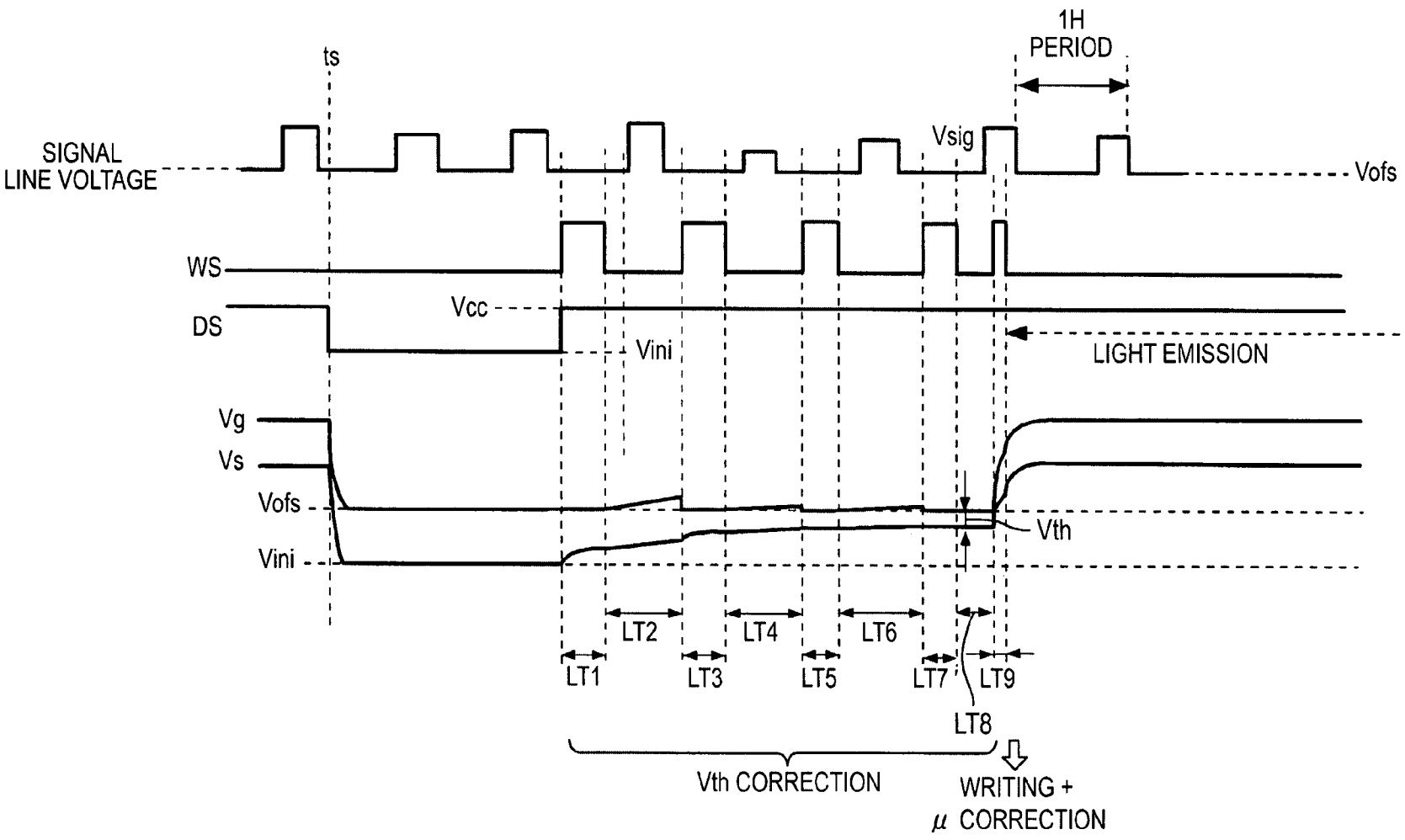
FIG. 3 is a diagram illustrating a pixel circuit operation when divided threshold correction is performed.

FIG. 3 illustrates a timing chart of the operation of the pixel circuit 10 in one cycle (one frame period).

FIG. 3 illustrates the signal line voltage which is applied to the signal line DTL by the horizontal selector 11. In this operation example, the horizontal selector 11 applies the threshold correction reference voltage Vofs as the signal line voltage and a pulse voltage as the video signal voltage Vsig to the signal line DTL within one horizontal period (1H).

Moreover, FIG. 3 illustrates the scan pulse WS which is applied to the gate of the sampling transistor Ts through the write control line WSL by the write scanner 13. The n-channel sampling transistor Ts is brought into a conduction state when the scan pulse WS is changed to the H level and a non-conduction state when the scan pulse WS is changed to the L level.

Furthermore, FIG. 3 illustrates the power pulse DS which is supplied from the drive scanner 12 through the power control line DSL. The drive voltage Vcc or the initial voltage Vini is applied as the power pulse DS.

Furthermore, FIG. 3 illustrates the changes in the gate voltage and source voltage of the drive transistor Td as examples of a gate voltage Vg and a source voltage Vs.

Time point ts in the timing chart of FIG. 3 corresponds to the starting time of one cycle (for example, one frame period of image display) in which the light emission of the organic EL device 1 used as the light-emitting device is driven.

First, at time point ts, the power pulse DS is changed to the initial potential Vini. Moreover, the scan pulse WS is changed to the H level, and the sampling transistor Ts is put into the ON state.

When the power pulse DS is changed to the initial potential Vini, the supply of the drive voltage Vcc is interrupted. Thus, the gate voltage and source voltage of the drive transistor Td decrease, the organic EL device 1 is extinguished, and a non-light emission period starts.

In this case, the source potential is equal to Vini, and the signal line voltage is applied to the gate of the drive transistor Td through the sampling transistor Ts. At this time, since the signal line voltage is equal to the threshold correction reference voltage Vofs, the gate potential is equal to Vofs.

Here, the initial potential Vini is set so as to satisfy a relation of (Vofs−Vini)>Vth. Vth is the threshold voltage of the drive transistor Td.

That is, as a preparing operation of the threshold correction, the gate-source voltage of the drive transistor is sufficiently increased to be larger than the threshold voltage Vth.

Subsequently, a first round of the threshold correction (Vth correction) is performed in period LT1.

In this case, when the signal line voltage becomes equal to the threshold correction reference voltage Vofs, the write scanner 13 simultaneously causes the scan pulse WS to be in the H level. At the same time, the drive scanner 12 causes the power pulse DS to be in the drive voltage Vcc.

By doing so, the source node voltage of the drive transistor Td increases with the gate node voltage being fixed to the threshold correction reference voltage Vofs.

This is because current flows from the power control line DSL towards the anode of the organic EL device 1 when the power pulse DS is in the drive voltage Vcc. As long as the anode potential Vel of the organic EL device 1 satisfies a relation of Vel≤(Vcat)+(Vthel) (where, Vthel is the threshold voltage of the organic EL device 1), the current of the drive transistor Td is used for charging the storage capacitor Cs and the capacitor Coled. Satisfying the relation of Vel≤(Vcat)+(Vthel) means that the leak current of the organic EL device 1 is significantly smaller than the current flowing to the drive transistor Td.

For this reason, the anode potential Vel (the source potential of the drive transistor Td) increases with time.

This threshold correction operation can be said to be an operation of making the gate-source voltage of the drive transistor Td identical to the threshold voltage Vth. Therefore, the source potential of the drive transistor Td may be increased until the gate-source voltage of the drive transistor Td becomes equal to the threshold voltage Vth.

However, the gate node potential can be fixed to the threshold correction reference voltage Vofs only when the signal line voltage is equal to Vofs. For this reason, in one round of the threshold correction operation, depending on a frame rate or the like, it may not be possible to secure sufficient time for increasing the source potential until the gate-source voltage reaches the threshold voltage Vth. Therefore, the threshold correction operation is divided into several rounds and performed in a time-divided manner.

For this reason, the threshold correction operation is halted in period LT2 before the signal line voltage becomes equal to the video signal voltage Vsig. That is, first, the write scanner 13 causes the scan pulse WS to be in the L level and puts the sampling transistor Ts into the OFF state.

At that time, since both the gate and source are in the floating state, a current flows between the drain and source in accordance with the gate-source voltage Vgs, and a bootstrap operation takes place. That is, the gate and source potentials increase as illustrated in FIG. 3.

Subsequently, a second round of the threshold correction is performed in period LT3. That is, the write scanner 13 causes the scan pulse WS to be in the H level again and puts the sampling transistor Ts into the ON state when the signal line voltage is equal to the threshold correction reference voltage Vofs. By doing so, the gate voltage of the drive transistor Td becomes equal to the threshold correction reference voltage Vofs, and the source potential increases.

In addition, the threshold correction operation is halted in period LT4. Since the gate-source voltage of the drive transistor Td has become closer to the threshold voltage Vth in the second round of the threshold correction, the amount of bootstrap in the second halt period is smaller than that in the first halt period.

Subsequently, a third round of the threshold correction is performed in period LT5, followed by a halt period of LT6 and a fourth round of the threshold correction in period LT7.

In this way, the gate-source voltage of the drive transistor Td finally becomes equal to the threshold voltage Vth.

At that time, the source potential (the anode potential Vel of the organic EL device 1) is given by an expression of Vofs−VthVcat+Vthel. Here, Vcat is the cathode potential, and the Vthel is the threshold voltage of the organic EL device 1.

In the example of FIG. 3, after the passage of period LT7 for the fourth round of the threshold correction, the scan pulse WS is changed to the L level, and the sampling transistor Ts is put into the OFF state. In this way, the threshold correction operation ends.

Although an example where the stage of correction is performed four times has been described, the number of rounds of the threshold correction operation is appropriately determined in accordance with the configuration and operation of the display apparatus. For example, the threshold correction operation may be performed two times, three times, and five times or more.

After that, after the passage of period LT8, in period LT9 in which the signal line voltage becomes equal to the video signal voltage Vsig, the write scanner 13 causes the scan pulse WS to be in the H level, and writing of the video signal voltage Vsig and a mobility correction operation are performed. That is, the video signal voltage Vsig is input to the gate of the drive transistor Td.

The gate potential of the drive transistor Td becomes equal to the potential of the video signal voltage Vsig. However, since the power control line DSL is in the drive voltage Vcc, a current flows, and the source potential increases with time.

At that time, if the source voltage of the drive transistor Td is not higher than the sum of the threshold voltage Vthel of the organic EL device 1 and the cathode voltage Vcat, the current of the drive transistor Td is used for charging the storage capacitor Cs and the capacitor Coled. That is, this condition is analogous to a condition that the leak current of the organic EL device 1 is significantly smaller than the current flowing to the drive transistor Td.

Moreover, at this time, since the threshold correction operation of the drive transistor Td has been completed, the current flowing to the drive transistor Td reflects the mobility μ.

Specifically, the larger the mobility, the larger the amount of current and the faster the increase in the source potential. Conversely, the smaller the mobility, the smaller the amount of current and the slower the increase in the source potential.

In this way, the gate-source voltage Vgs of the drive transistor Td decreases while reflecting the mobility and becomes equal to a voltage that completely corrects the mobility after the passage of a predetermined period.

In this manner, after writing of the video signal voltage Vsig and the mobility correction operation are performed, the gate-source voltage Vgs is determined, a bootstrap operation is performed, and a light emission period starts.

As described above, the pixel circuit 10 performs an operation of allowing the organic EL device 1 to emit light, which includes a threshold correction operation and a mobility correction operation, as an operation of driving one light emission cycle in one frame period.

Through the threshold correction operation, a current corresponding to the signal potential Vsig can be applied to the organic EL device 1 regardless of variations in the threshold voltage Vth of the drive transistor Td in each pixel circuit 10 or the changes in the threshold voltage Vth due to aging. That is, it is possible to cancel the variations in the threshold voltage Vth due to variations in manufacturing processes or aging to maintain high image quality without causing luminance unevenness on the screen.

Since the drain current also changes in accordance with the mobility of the drive transistor Td, image quality decreases due to the variations in the mobility of the drive transistor Td in each pixel circuit 10. However, through the mobility correction operation, the source potential Vs can be obtained based on the magnitude of mobility of the drive transistor Td. As a result, since the source potential Vs is adjusted to the gate-source voltage Vgs which absorbs the variations in the mobility of the drive transistor Td in each pixel circuit 10, image quality reduction due to the variations in mobility is also prevented.

Moreover, the threshold correction operation is divided into several rounds and performed in a time-divided manner as the pixel circuit operation for one cycle so as to comply with the demand for higher operation frequency of the display apparatus.

As the frame rate becomes higher, the operation time of the pixel circuit becomes relatively shorter. Therefore, it is difficult to secure a continuous threshold correction period (period where the signal line voltage is equal to the threshold correction reference voltage Vofs). Accordingly, the period desired for the threshold correction period is secured by performing the threshold correction operation in the time-divided manner as described above, and the gate-source voltage of the drive transistor Td is made identical to the threshold voltage Vth.

[3. Pixel Circuit Operation Considered in the Process of Achieving the Invention: STC Driving]

However, if the frame rate increases further, it is desired to perform the divided threshold correction operation more often in order to secure the threshold correction period.

Here, an STC driving method is developed as a drive method that can appropriately secure the threshold correction period.

The operation of the STC driving method will be described.

In this example, as described above with reference to FIG. 1, three horizontal lines are grouped as one unit, for example, and a light emission driving operation including the threshold correction operation is performed for each unit.

Figure 4:
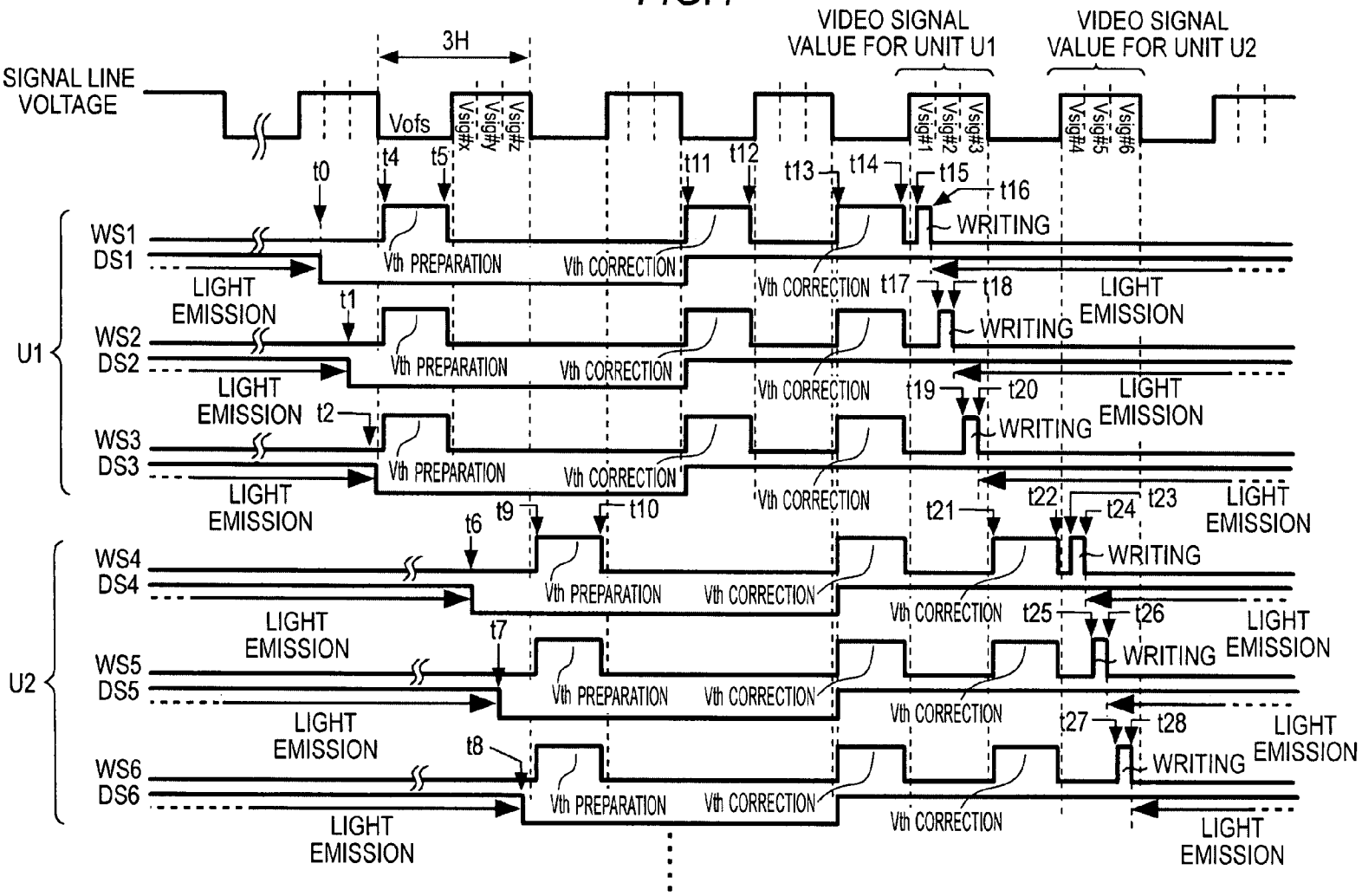
FIG. 4 is a diagram illustrating a pixel circuit operation when STC driving is performed.

FIG. 4 illustrates the signal line voltage, scan pulse WS, and power pulse DS when the STC driving method is performed.

FIG. 4 illustrates the pulses supplied to a unit U1, specifically the scan pulse WS1 and power pulse DS1 corresponding to pixels on the first line in FIG. 1, the scan pulse WS2 and power pulse DS2 corresponding to pixels on the second line, and the scan pulse WS3 and power pulse DS3 corresponding to pixels on the third line.

Moreover, FIG. 4 illustrates the pulses supplied to a unit U2, specifically the scan pulse WS4 and power pulse DS4 corresponding to pixels on the fourth line, the scan pulse WS5 and power pulse DS5 corresponding to pixels on the fifth line, and the scan pulse WS6 and power pulse DS6 corresponding to pixels on the sixth line, which are not illustrated in FIG. 1.

The signal line voltage which is applied to the signal line DTL by the horizontal selector 11 in three horizontal periods (3H) includes the threshold correction reference voltage Vofs and a pulse voltage which includes three video signal voltages Vsig#x, Vsig#y, and Vsig#z.

The 3H period corresponds to a period when three horizontal lines are grouped and processed as one unit.

For example, the video signal voltages Vsig which are applied to each pixel circuit 10 of the unit U1 (the first to third lines) through one signal line DTL are illustrated as Vsig#1, Vsig#2, and Vsig#3. Moreover, the video signal voltages Vsig which are applied to each pixel circuit 10 of the unit U2 (the fourth to sixth lines) are illustrated as Vsig#4, Vsig#5, and Vsig#6.

In this example, it is assumed that the video signal voltages Vsig are applied so that all pixels on the screen emit light at the same luminance levels, and Vsig#1=Vsig#2=Vsig#3=Vsig#4=Vsig#5=Vsig#6, . . . , and Vsig#x=Vsig#y=Vsig#z. In a normal video display, the respective video signal voltages Vsig have voltage values corresponding to the luminance levels of the corresponding pixel circuits 10.

The horizontal selector 11 applies the threshold correction reference voltage Vofs and the video signal voltages Vsig#1, Vsig#2, and Vsig#3 to the signal line DTL in a certain 3H period (period where the video signal voltage Vsig for the unit U1 is output).

In a next 3H period which is a period where the video signal voltage Vsig for the unit U2 is output, the threshold correction reference voltage Vofs, and the video signal voltages Vsig#4, Vsig#5, and Vsig#6 are applied to the signal line DTL.

In this STC driving method, the write scanner 13 outputs the scan pulse WS to the respective pixel circuits in one unit so that the threshold correction operation is simultaneously performed within one emission cycle of the pixel circuits. That is, the scan pulse WS is output so that the threshold correction reference voltage Vofs is simultaneously input to the respective pixel circuits.

The driving of the pixel circuits 10 on each line by the scan pulse WS and power pulse DS is performed in the following manner.

As for the pixel circuits 10 on the first line, at time point t0, the power pulse DS1 is changed to the initial potential Vini, alight emitting period for the previous frame ends, and a light emitting operation for one cycle of the present frame starts.

As for the pixel circuits 10 on the second line, at time point t1, the power pulse DS2 is changed to the initial potential Vini, a light emitting period for the previous frame ends, and a light emitting operation for one cycle of the present frame starts.

As for the pixel circuits 10 on the third line, at time point t2, the power pulse DS3 is changed to the initial potential Vini, alight emitting period for the previous frame ends, and a light emitting operation for one cycle of the present frame starts.

The reason why the light emission ending timings of the respective pixels of the unit U1 take place at the different time points t0, t1, and t2 is because the light emission starting timings take place at different time points t16, t18, and t20 described later. That is, this is to ensure the same emission periods for the pixel circuits 10 on each line so that no difference in the luminance level is visible.

When the respective pixels of the unit U1 enter the non-light emission state at time points t0, t1, and t2, first, a preparing operation for threshold correction is simultaneously performed in a period t4 to t5.

That is, in a period where the signal line voltage is equal to the threshold correction reference voltage Vofs, the scan pulses WS1, WS2, and WS3 are simultaneously changed to the H level.

In this way, the gate voltages Vg of the drive transistors of the respective pixel circuits 10 on the first to third lines are changed to the threshold correction reference voltage Vofs. Moreover, the source potential is equal to Vini.

Since the initial potential Vini is set so as to satisfy a relation of Vofs−Vini>Vth, as a preparing operation of the threshold correction, the gate-source voltage of the drive transistor is sufficiently increased to be larger than the threshold voltage Vth.

Subsequently, in a period t11 to t12, a first round of the threshold correction is simultaneously performed on the respective pixel circuits 10 on the first to third lines.

That is, in a period where the signal line voltage is equal to the threshold correction reference voltage Vofs, the scan pulses WS1, WS2, and WS3 are simultaneously changed to the H level, and the power pulses DS1, DS2, and DS3 are simultaneously changed to the drive voltage Vcc.

By doing so, the source node voltages of the drive transistors Td in the respective pixel circuits 10 on the first to third lines increase with the gate node voltages being fixed to the threshold correction reference voltage Vofs. That is, the gate-source voltage Vgs becomes closer to the threshold voltage Vth.

The first round of the threshold correction operation ends when the scan pulses WS1, WS2, and WS3 are simultaneously changed to the L level, and the threshold correction operation is halted in a period where the signal line voltage is equal to the video signal voltage Vsig.

Subsequently, in a period t13 to t14, a second round of the threshold correction is simultaneously performed for the respective pixel circuits 10 on the first to third lines.

That is, in a period where the signal line voltage is equal to the threshold correction reference voltage Vofs, the scan pulses WS1, WS2, and WS3 are simultaneously changed to the H level, whereby the second round of the threshold correction operation is performed.

In this example, although the threshold correction operation is divided into two rounds and performed, by the second round of the threshold correction operation, the gate-source voltage Vgs of the drive transistor Td becomes equal to the threshold voltage Vth, and the threshold correction operation ends.

Subsequently, writing of the video signal voltage Vsig is performed sequentially.

First, in a period t15 to t16 where the video signal voltage Vsig#1 is applied by the horizontal selector 11 as the signal line voltage, writing is performed on the pixel circuits 10 on the first line. That is, in the period t15 to t16, the scan pulse WS1 is changed to the H level.

In this way, in the respective pixel circuits 10 on the first line, the video signal voltage Vsig#1 is written to the gate of the drive transistor Td, and the power control line DSL is at the drive voltage Vcc. Therefore, a current flows to the drive transistor Td, the source potential increases with time, and a mobility correction operation is performed.

In this way, the writing of the video signal voltage Vsig#1 and the mobility correction operation are performed, the gate-source voltage Vgs is determined, and a light emission period starts at a time point later than t16.

Moreover, in a period t17 to t18 where the video signal voltage Vsig#2 is applied by the horizontal selector 11 as the signal line voltage, the scan pulse WS2 is changed to the H level, and writing is performed on the pixel circuits 10 on the second line. That is, in the respective pixel circuits 10 on the second line, the video signal voltage Vsig#2 is written to the gate of the drive transistor Td, and a mobility correction operation is performed. Moreover, a light emission period starts at a time point later than t18.

Furthermore, in a period t19 to t20 where the video signal voltage Vsig#3 is applied by the horizontal selector 11 as the signal line voltage, the scan pulse WS3 is changed to the H level, and writing is performed on the pixel circuits 10 on the third line. That is, in the respective pixel circuits 10 on the third line, the video signal voltage Vsig#3 is written to the gate of the drive transistor Td, a mobility correction operation is performed, and a light emission period starts at a time point later than t20.

The light emitting operation for one cycle of the respective pixel circuits of the unit U1 is performed in the above described manner.

In the unit U2, the same operation is performed for the respective pixel circuits 10 on the fourth to sixth lines with a delay of a 3H period from that of the unit U1.

That is, at time points t6, t7, and t8, the power pulses DS4, DS5, and DS6 are changed to the initial potential Vini, respectively, a light emitting period for the previous frame of the respective pixel circuits 10 on the fourth to sixth lines ends sequentially, and a light emitting operation for one cycle of the present frame starts.

In a period t9 to t10, the scan pulses WS4, WS5, and WS6 are simultaneously changed to the H level, and a preparing operation for threshold correction is simultaneously performed in the respective pixel circuits 10 on the fourth to sixth lines. In this way, the gate voltages Vg of the drive transistors of the respective pixel circuits 10 on the fourth to sixth lines are changed to the threshold correction reference voltage Vofs. Moreover, the source potential is equal to Vini. That is, the gate-source voltages of the respective drive transistors are sufficiently increased to be larger than the threshold voltage Vth.

Subsequently, in a period t13 to t14, the scan pulses WS4, WS5, and WS6 are simultaneously changed to the H level, and the power pulses DS4, DS5, and DS6 are simultaneously changed to the drive voltage Vcc. In this way, a first round of the threshold correction is simultaneously performed on the respective pixel circuits 10 on the fourth to sixth lines.

Furthermore, after the passage of a correction halt period, in a period t21 to t22, the scan pulses WS4, WS5, and WS6 are simultaneously changed to the H level, and a second round of the threshold correction is simultaneously performed on the respective pixel circuits 10 on the fourth to sixth lines.

Moreover, writing of the video signal voltages Vsig#4, Vsig#5, and Vsig#6 are performed sequentially.

First, in a period t23 to t24 where the signal line voltage is equal to the video signal voltage Vsig#4, the scan pulse WS4 is changed to the H level, and writing of the video signal voltage Vsig#4 and a mobility correction operation are performed on the pixel circuits 10 on the fourth line. Moreover, a light emission period starts at a time point later than t24.

In a period t25 to t26 where the signal line voltage is equal to the video signal voltage Vsig#5, the scan pulse WS5 is changed to the H level, and writing of the video signal voltage Vsig#5 and a mobility correction operation are performed on the pixel circuits 10 on the fifth line. Moreover, a light emission period starts at a time point later than t26.

In a period t27 to t28 where the signal line voltage is equal to the video signal voltage Vsig#6, the scan pulse WS6 is changed to the H level, and writing of the video signal voltage Vsig#6 and a mobility correction operation are performed on the pixel circuits 10 on the sixth line. Moreover, a light emission period starts at a time point later than t28.

In the STC driving method, the threshold correction operation and the like are performed collectively for each unit as described above.

Executing the threshold correction operation every three lines means that the 3H period can be used for one operation of making the signal line voltage identical to the threshold correction reference voltage Vofs and the video signal voltage Vsig. That is, a longer period can be secured for the threshold correction operation. Thus, the STC driving method is an effective drive method for increasing an operation margin even with an increase in the pulse transit time accompanied by the higher frame rate and the larger panel size.

Figure 5A:
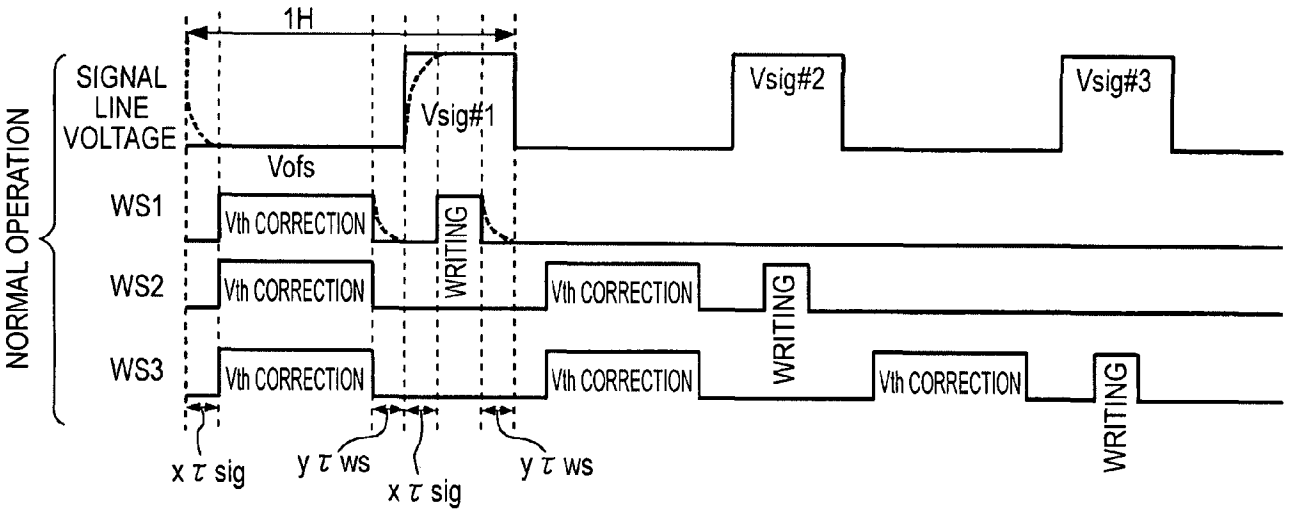
FIGS. 5A and 5B are diagrams illustrating a threshold correction period when STC driving is performed.
Figure 5B:
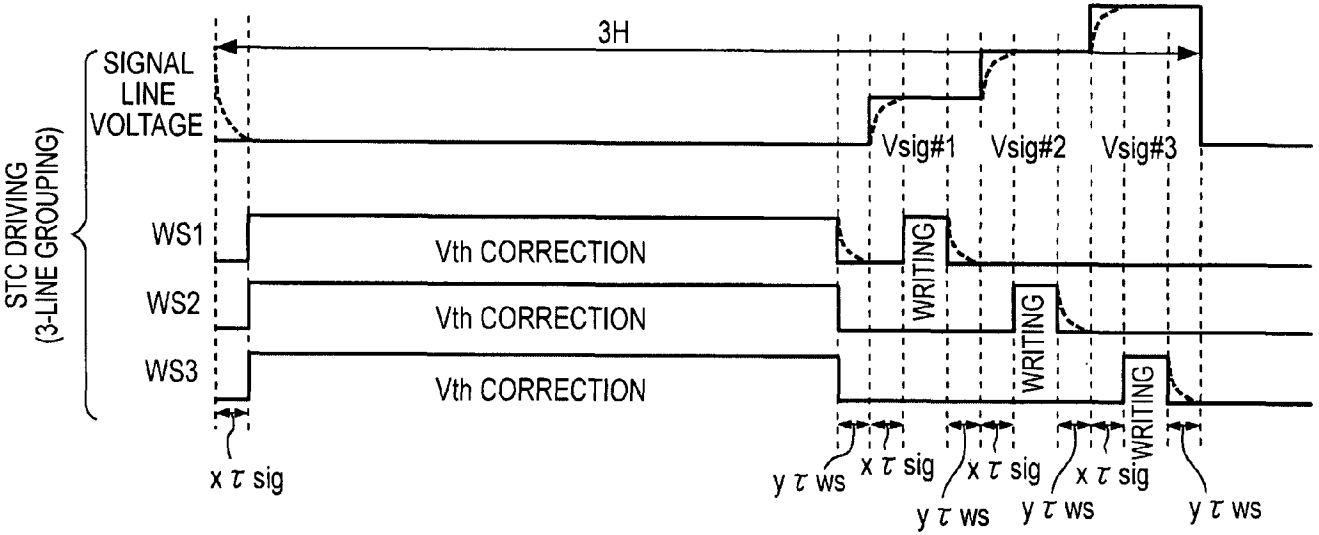

FIGS. 5A and 5B illustrate threshold correction periods when a general divided threshold correction operation (the example of FIG. 3) and an STC driving method are performed, respectively.

In the case of FIG. 5A where the divided threshold correction operation is performed as illustrated in FIG. 3, one round of the threshold correction operation can be performed in only a period within a 1H period where the signal line voltage is equal to the threshold correction reference voltage Vofs.

In contrast, in the case of FIG. 5B where the STC driving method is performed, since the operation is performed every 3H period, it is possible to secure a longer period where the signal line voltage is equal to the threshold correction reference voltage Vofs and increase the period for one round of the threshold correction operation.

This will be described in more detail. The desired periods other than the threshold correction period and the video signal write period are the transition period ($x\tau ws$) of the signal line voltage pulse and the transition period ($y\tau ws$) of the scan pulse WS.

In the case of the normal operation illustrated in FIG. 5A, the total transition period is $2(x\tau sig+y\tau ws)$ for one line. The total becomes $6(x\tau sig+y\tau ws)$ for three lines.

On the other hand, in the case of the 3-line based STC driving method illustrated in FIG. 5B, the total transition period is $4(x\tau sig+y\tau ws)$. That is, a time margin of the threshold correction can be increased by an amount of $2(x\tau sig+y\tau ws)$.

Given the above, in the case of an X-line based STC driving method, the time margin is increased by an amount of $(X-1)(x\tau sig+y\tau ws)$ compared to the normal driving method.

For this reason, the STC driving method can be said to be an effective drive method for increasing an operation margin even with an increase in the pulse transit time accompanied by the higher frame rate and the larger panel size.

Therefore, since the STC driving method ensures a longer threshold correction period, the method is advantageous for realizing a higher frame rate and a larger panel.

However, the STC driving method involves the following problems.

Attention is now paid to a waiting term which continues after the end of the final round of the threshold correction until the start of a signal write operation. For example, in the case of the unit U1 in FIG. 4, the final threshold correction operation is the second round of the threshold correction operation in the period t13 to t14, and the waiting term continues from the ending time point t14 until the start of the writing of the video signal voltages Vsig1, Vsig2, and Vsig3.

Figure 6:
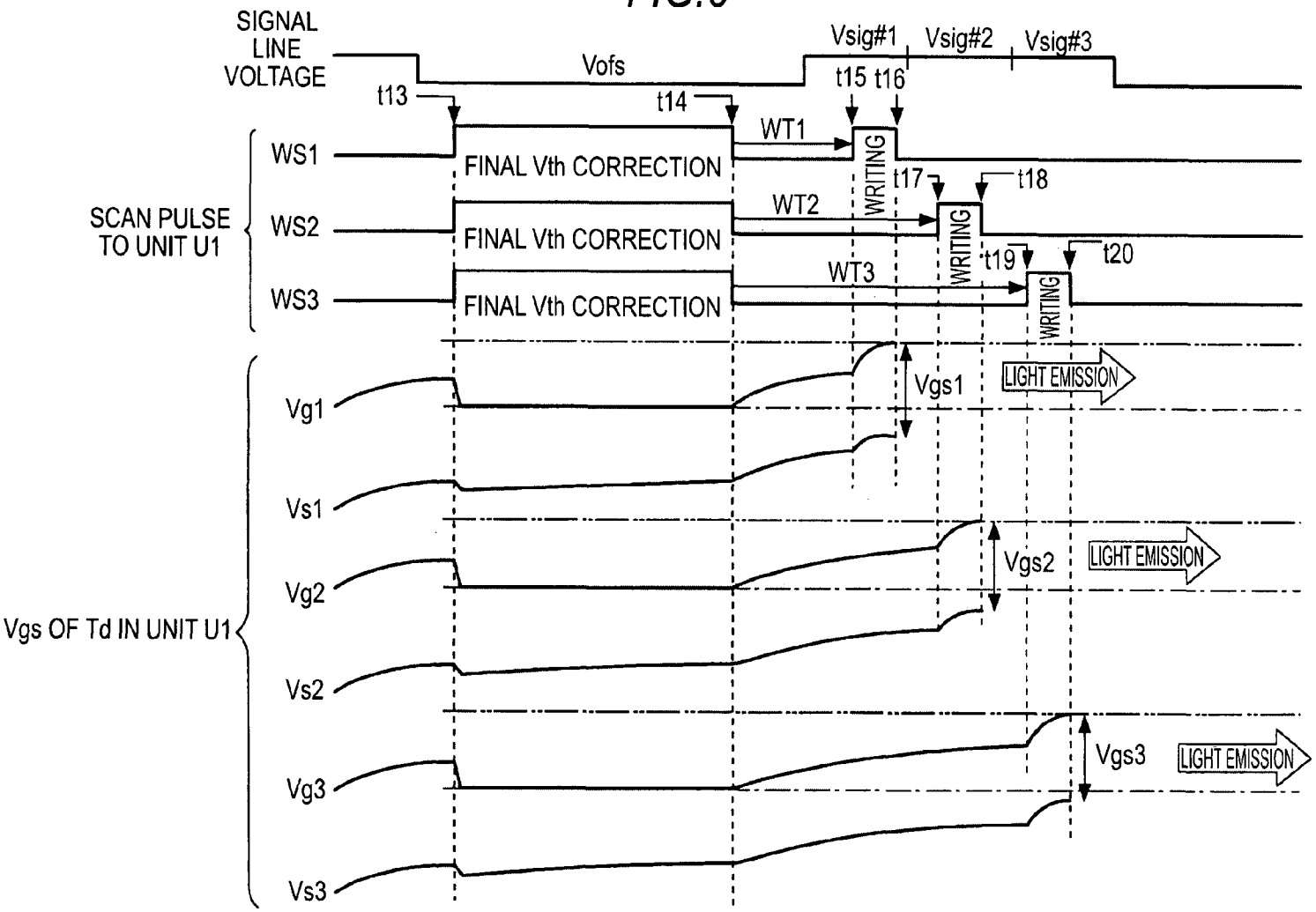
FIG. 6 is a diagram illustrating variations in a gate-source voltage due to a leak current in the STC driving.

In FIG. 6, the period in which the final threshold correction operation and the signal write operation are performed in the unit U1 is illustrated in an enlarged scale. Specifically, the gate voltage and source voltage of the drive transistor Td in each of the pixel circuits 10 on each line are illustrated.

Vg1 and Vs1 are the gate voltage and source voltage of the drive transistor Td in each of the pixel circuits 10 on the first line, respectively.

Vg2 and Vs2 are the gate voltage and source voltage of the drive transistor Td in each of the pixel circuits 10 on the second line, respectively.

Vg3 and Vs3 are the gate voltage and source voltage of the drive transistor Td in each of the pixel circuits 10 on the third line, respectively.

The respective gate-source voltages of the drive transistors Td in the pixel circuits 10 on each line are illustrated as Vgs1, Vgs2, and Vgs3, respectively.

After the final threshold correction operation is performed in the period t13 to t14, the gate-source voltage Vgs is approximately equal to Vth in the drive transistors Td on each line.

Although the threshold correction operation has been completed, and Vgs is approximately equal to Vth, a very small leak current is continuously flowing between the drain and source of the drive transistor Td (generally, the current Ids after threshold correction is approximately equal to 1 pA).

Here, the waiting term WT which continues from the end of the threshold correction operation to the start of a video signal write operation is different from line to line in the same unit.

That is, the waiting terms WT1, WT2, and WT3 of the first, second, and third lines in the unit U1 satisfy a relation of WT1<WT2<WT3.

The fact that the waiting term increases as the line number increases implies that the increase in the source voltage Vs resulting from the leak current of the drive transistor Td increases as the line number increases. Thus, the gate-source voltages Vgs in the same unit immediately before the video signal voltage Vsig is written, satisfy a relation of Vgs1>Vgs2>Vgs3.

That is, due to the phenomenon that as the waiting term WT increases, namely the line number increases, the increase in the source voltage Vs resulting from the leak current increases, the gate-source voltage Vgs decreases, and a difference in the gate-source voltages Vgs occurs at the time point before the video signal voltage Vsig is written.

Figure 7:
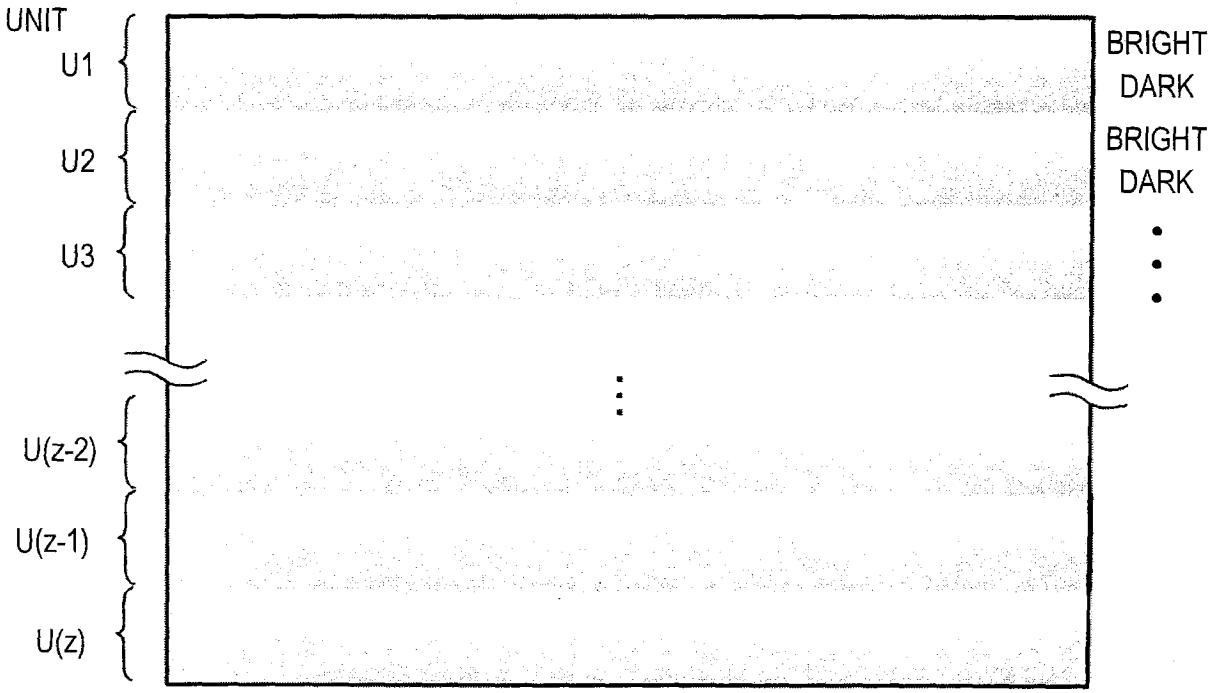
FIG. 7 is a diagram illustrating shading caused by STC driving.

Moreover, when the same video signal voltage (Vsig1=Vsig2=Vsig3) is written in the unit in such a state in the case of FIG. 7, shading is observed on the screen in which the luminance level decreases as the line number in the unit increases. Moreover, such shading appears in a form of lines between different units in the raster display mode, and thus, uniformity deteriorates.

[4. Pixel Circuit Operation of Embodiment]

The pixel circuit operation according to the present embodiment aims to prevent the above-described uniformity deterioration while using the STC driving method.

Figure 8:
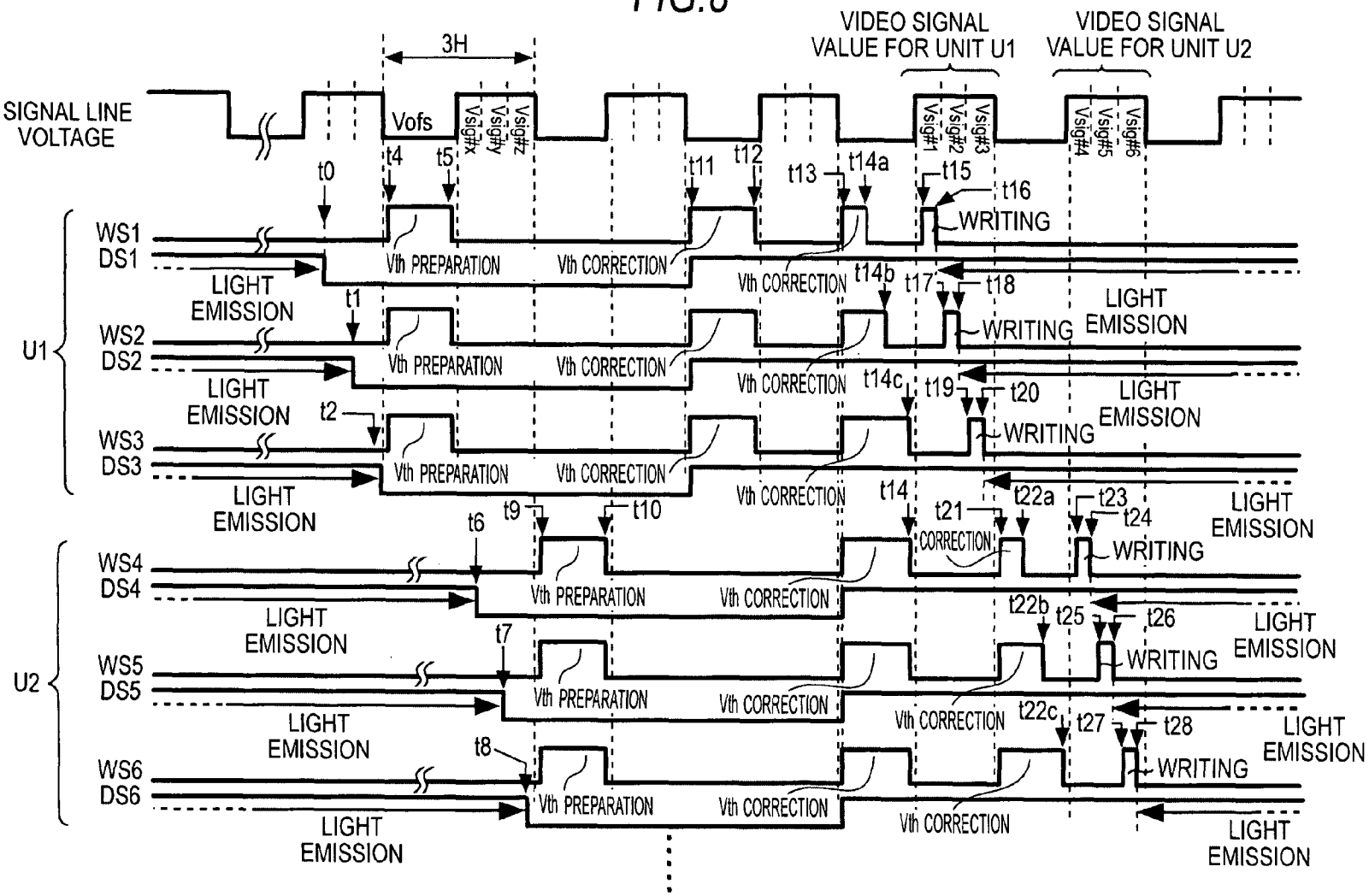
FIG. 8 is a diagram illustrating STC driving according to an embodiment of the invention.

The pixel circuit operation of the embodiment will be described with reference to FIGS. 8 to 10. FIG. 8 illustrates the signal line voltage, and the respective scan pulses WS (WS1 to WS6) and power pulses DS (DS1 to DS6) to the units U1 and U2 in the same format as FIG. 4.

Similarly to the case of FIG. 4, the signal line voltage which is applied to the signal line DTL by the horizontal selector 11 in three horizontal periods (3H) includes the threshold correction reference voltage Vofs and a pulse voltage which includes three video signal voltages Vsig#x, Vsig#y, and Vsig#z.

The driving of the pixel circuits 10 on each line by the scan pulse WS and power pulse DS is performed in the following manner.

Similarly to the case of FIG. 4, as for the respective pixel circuits 10 on the first to third lines, the power pulses DS1, DS2, and DS3 are changed to the initial potential Vini at time points t0, t1, and t2, respectively, and a light emitting period for the previous frame ends.

When the respective pixels of the unit U1 enter the non-light emission state at time points t0, t1, and t2, first, a preparing operation for threshold correction is simultaneously performed in a period t4 to t5.

That is, in a period where the signal line voltage is equal to the threshold correction reference voltage Vofs, the scan pulses WS1, WS2, and WS3 are simultaneously changed to the H level.

In this way, the gate voltages Vg of the drive transistors of the respective pixel circuits 10 on the first to third lines are changed to the threshold correction reference voltage Vofs, and the source potential becomes equal to Vini. Thus, the gate-source voltage of the drive transistor Td is sufficiently increased to be larger than the threshold voltage Vth.

Subsequently, in a period t11 to t12, a first round of the threshold correction is simultaneously performed on the respective pixel circuits 10 on the first to third lines.

That is, in a period where the signal line voltage is equal to the threshold correction reference voltage Vofs, the scan pulses WS1, WS2, and WS3 are simultaneously changed to the H level, and the power pulses DS1, DS2, and DS3 are simultaneously changed to the drive voltage Vcc.

By doing so, the source node voltages of the drive transistors Td in the respective pixel circuits 10 on the first to third lines increase with the gate node voltages being fixed to the threshold correction reference voltage Vofs. That is, the gate-source voltage Vgs becomes closer to the threshold voltage Vth.

The first round of the threshold correction operation ends when the scan pulses WS1, WS2, and WS3 are changed to the L level at time point t12 when the signal line voltage is not yet equal to the video signal voltage Vsig, and the threshold correction operation is halted in a period where the signal line voltage is equal to the video signal voltage Vsig.

Subsequently, at time point t13, a second round of the threshold correction starts simultaneously in the respective pixel circuits 10 on the first to third lines.

In this example, the second round of the threshold correction is the final threshold correction operation of the divided threshold correction.

Although the second (final) round of the threshold correction operation starts simultaneously in the respective pixel circuits 10 on the first to third lines, the ending time points thereof are different.

This final threshold correction operation starts when the scan pulses WS1, WS2, and WS3 are simultaneously changed to the H level at time point t13 when the signal line voltage is equal to the threshold correction reference voltage Vofs. By this final threshold correction operation, the gate-source voltage Vgs of the drive transistor Td becomes equal to the threshold voltage Vth, and the threshold correction operation ends.

Here, the scan pulse WS1 is changed to the L level at time point t14*a*. Moreover, the scan pulse WS2 is changed to the L level at time point t14*b*, and the scan pulse WS3 is changed to the L level at time point t14*c*.

That is, the pulse widths of the scan pulses WS used for the final threshold correction operation satisfy a relation of WS1<WS2<WS3.

For this reason, the final threshold correction operation for the pixel circuits 10 on the first line is performed in the shortest period, and the final threshold correction operation for the pixel circuits 10 on the third line is performed in the longest period.

Subsequently, writing of the video signal voltage Vsig is performed sequentially.

First, in a period t15 to t16 where the video signal voltage Vsig#1 is applied by the horizontal selector 11 as the signal line voltage, the scan pulse WS1 is changed to the H level, and writing of the video signal voltage Vsig#1 and a mobility correction operation are performed on the pixel circuits 10 on the first line. Moreover, a light emission period starts at a time point later than t16.

Moreover, in a period t17 to t18 where the video signal voltage Vsig#2 is applied by the horizontal selector 11 as the signal line voltage, the scan pulse WS2 is changed to the H level, and writing of the video signal voltage Vsig#2 and a mobility correction operation are performed on the pixel circuits 10 on the second line. Moreover, a light emission period starts at a time point later than t18.

Furthermore, in a period t19 to t20 where the video signal voltage Vsig#3 is applied by the horizontal selector 11 as the signal line voltage, the scan pulse WS3 is changed to the H level, and writing of the video signal voltage Vsig#3 and a mobility correction operation are performed on the pixel circuits 10 on the third line. Moreover, a light emission period starts at a time point later than t20.

In the unit U2, the same operation is performed for the respective pixel circuits 10 on the fourth to sixth lines with a delay of a 3H period from that of the unit U1.

That is, at time points t6, t7, and t8, the power pulses DS4, DS5, and DS6 are changed to the initial potential Vini, respectively, a light emitting period for the previous frame of the respective pixel circuits 10 on the fourth to sixth lines ends, and a light emitting operation for one cycle of the present frame starts.

In a period t9 to t10, the scan pulses WS4, WS5, and WS6 are simultaneously changed to the H level, and a preparing operation for threshold correction is simultaneously performed in the respective pixel circuits 10 on the fourth to sixth lines.

Subsequently, in a period t13 to t14, the scan pulses WS4, WS5, and WS6 are simultaneously changed to the H level, and the power pulses DS4, DS5, and DS6 are simultaneously changed to the drive voltage Vcc. In this way, a first round of the threshold correction is simultaneously performed on the respective pixel circuits 10 on the fourth to sixth lines.

Furthermore, after the passage of a correction halt period, at a period point t21, the scan pulses WS4, WS5, and WS6 are simultaneously changed to the H level, and a second (final) round of the threshold correction starts.

The ending time points of the final threshold correction operation are different. That is, the scan pulses WS4, WS5, and WS6 are changed to the L level at different time points t22*a*, t22*b*, and t22*c*, respectively.

After that, in periods t23 to t24, t25 to t26, and t27 to t28, the video signal voltages Vsig#4, Vsig#5, and Vsig#6 are sequentially written to the respective pixel circuits 10 on the fourth to sixth lines, respectively, and a light emission period starts.

Figure 9A:
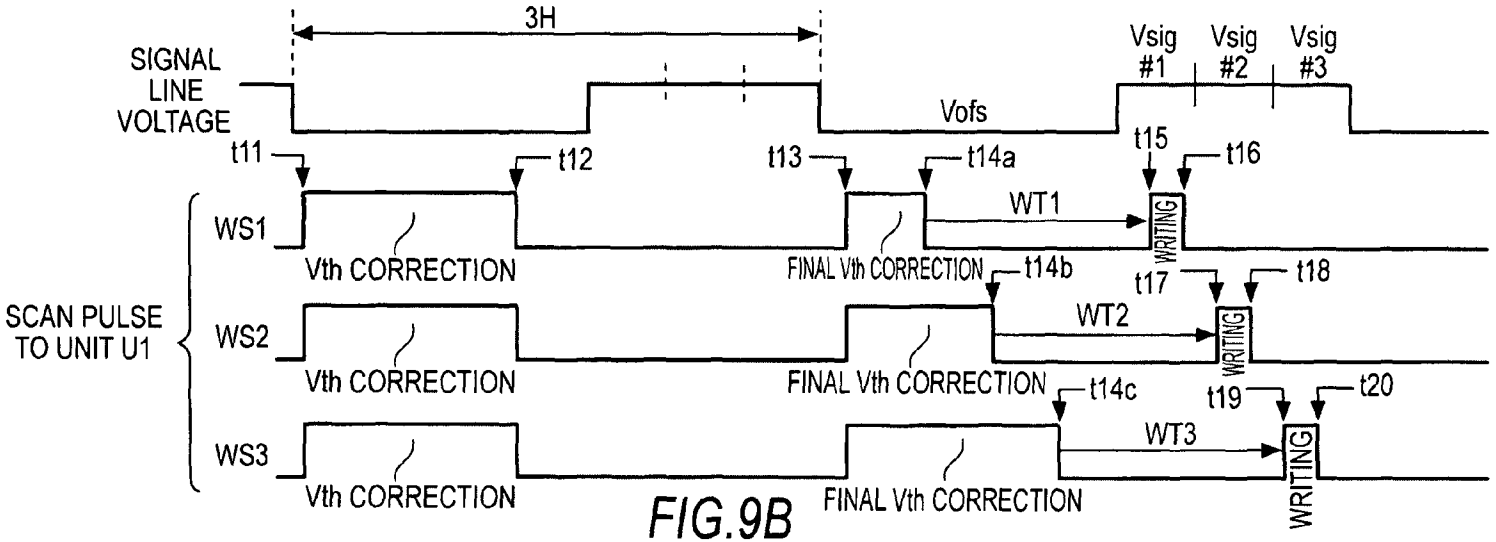
FIGS. 9A and 9B are diagrams illustrating the ending time point of a final threshold correction in the STC driving according to the embodiment.
Figure 9B:
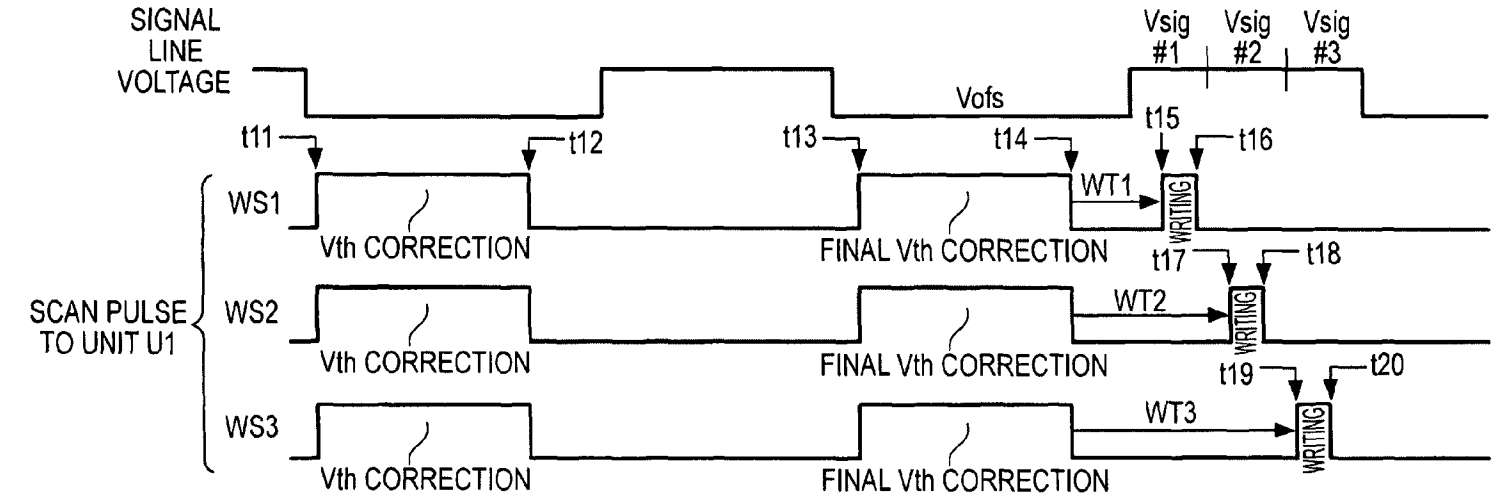

As described above, in the STC driving method of the present embodiment, the ending time points of the final threshold correction operation of the divided threshold correction in the respective pixel circuits 10 in the unit are different. In FIG. 9A, the signal line voltage and the scan pulses WS1, WS2, and WS3 in the period (t11 to t20) in FIG. 8 in which the first round of the threshold correction and the signal write operation are performed are illustrated in an enlarged scale. FIG. 9B illustrates the same voltage and pulses for comparison with the case of the STC driving described in FIG. 4.

As described earlier, in the case of the STC driving method described in FIG. 4, as illustrated in FIG. 9B, the waiting terms WT1, WT2, and WT3 which continue from the end of the final threshold correction to the start of the writing of the video signal voltages Vsig1, Vsig2, and Vsig3 are different in the respective pixel circuits 10 on the first to third lines. For this reason, the amounts of increase in the source voltage Vs caused by the leak current during the waiting terms are different, and the amounts of variation in the gate-source voltages Vgs immediately before the writing of the video signal voltage Vsig are different in each pixel circuit 10. Therefore, even when the same video signal voltage Vsig is written, shading as illustrated in FIG. 7 occurs in the unit.

In contrast, in the present embodiment, as illustrated in FIG. 9A, the waiting terms are the same so that WT1=WT2=WT3.

The time points t14*a*, t14*b*, and t14*c* serving as the ending time points of the final threshold correction are set in accordance with the starting time points t15, t17, and t19 of the writing of the video signal voltage Vsig to the respective pixel circuits 10. That is, the time points t14*a*, t14*b*, and t14*c* serving as the ending time points are determined so as to comply with the difference between the starting time points t15, t17, and t19 of the writing of the video signal voltage Vsig so that the waiting terms are the same, namely WT1=WT2=WT3. In other words, in this case, the pulse widths of the respective scan pulses WS1, WS2, and WS3 used for the final threshold correction are optimized so that the waiting terms are the same.

Figure 10:
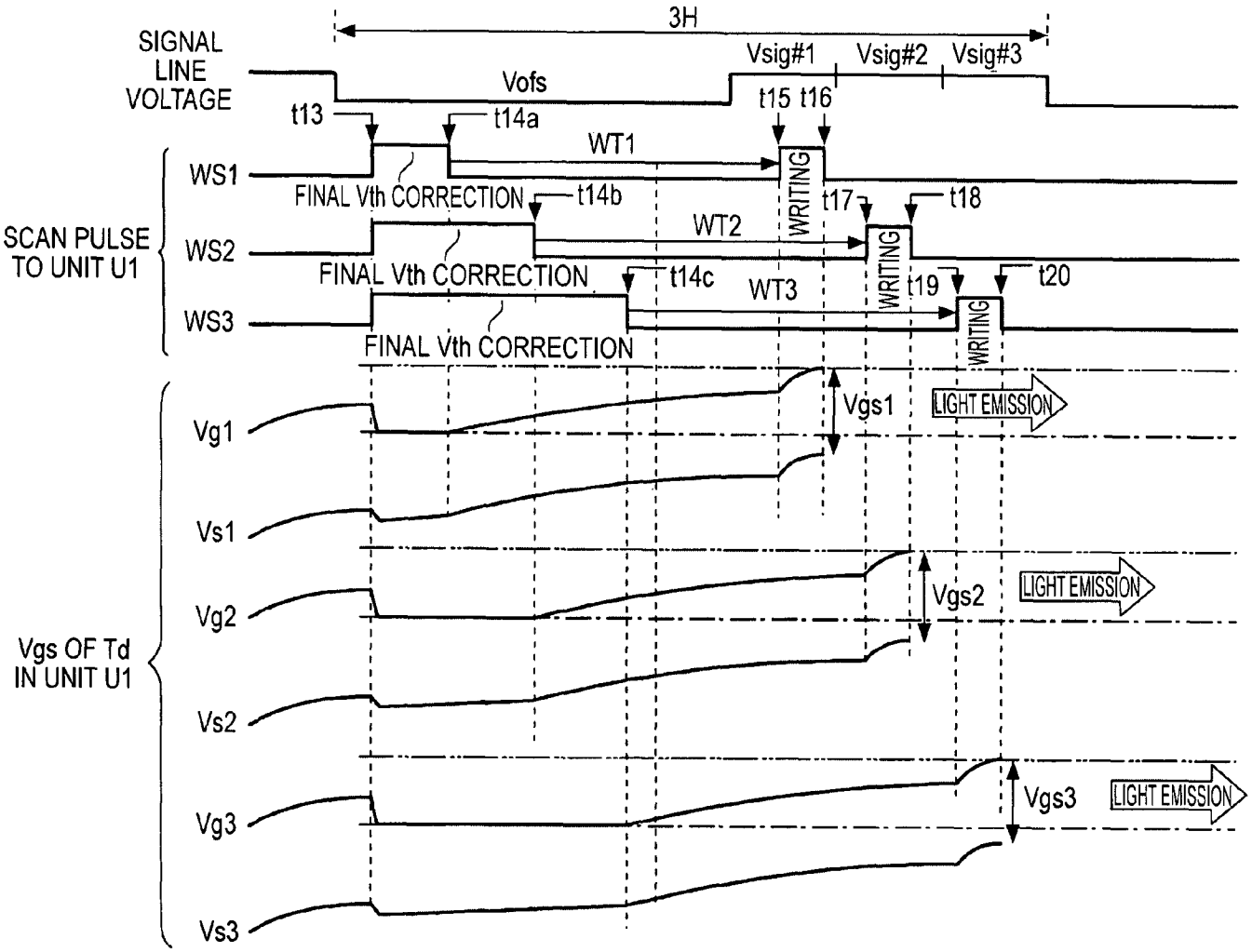
FIG. 10 is a diagram illustrating the eliminated influence of a leak current in the STC driving according to the embodiment.

FIG. 10 illustrates the scan pulse WS (WS1 to WS3) and the gate voltage Vg (Vg1 to Vg3) and source voltage Vs (Vs1 to Vs3) of the drive transistor Td in the period in which the final threshold correction and the video signal voltage write operation are performed on the respective pixel circuits 10 of the unit U1 in the same format as FIG. 6.

As illustrated in FIG. 10, in the pixel circuits 10 on each line, the waiting terms are the same, namely, WT1=WT2=WT3. In the respective pixel circuits 10, the source voltage Vs increases due to the leak current during the waiting term, and accordingly, the gate voltage Vg increases.

However, since the waiting terms are the same, namely WT1=WT2=WT3, the amounts of variation in the source voltages Vs1, Vs2, and Vs3 are substantially the same.

In the case of the STC driving method of the present embodiment, as compared to the case of the STC driving method of FIG. 4, the final threshold correction periods are different in each pixel circuit 10, and the influence of which will be discussed below.

That is, although in the case of FIG. 4, the waiting terms are different in each pixel circuit 10, in the case of the present embodiment, the final threshold correction periods are different in each pixel circuit 10.

The largest difference is the state of the gate voltage Vg. The gate of the drive transistor Td is in the floating state during the waiting term, and when the current Ids flows so that the source voltage Vs increases, both the gate voltage Vg and source voltage Vs increase while maintaining the substantially constant gate-source voltage Vgs.

On the other hand, since the gate voltage Vg (=threshold correction reference voltage Vofs) is at the ground potential during the final threshold correction period, only the source voltage Vs increases. However, at this time, the current Ids decreases as the source voltage Vs increases.

Therefore, the different threshold correction periods in each pixel circuit 10 have little influence on the difference in the variations of the gate-source voltage Vgs.

That is, even when the final threshold correction periods are different, the variations in the gate-source voltage Vgs can be suppressed as compared to the case where the waiting terms are different.

In the present embodiment, the final threshold correction period for the pixel circuits 10 on the starting line (first line) is shorter than that on the subsequent line in the unit. Here, whether sufficient threshold correction is achieved or not can be an issue.

However, only the final threshold correction period decreases and the preceding threshold correction operations are performed similarly on each line.

For example, in the examples of FIGS. 8 and 9, the first round of the threshold correction operation is performed similarly on the pixel circuits 10 on each line.

By the time when the final threshold correction starts, the gate-source voltage Vgs of the drive transistor Td in each of the pixel circuits 10 is quite close to the threshold voltage Vth. For this reason, in the final threshold correction, the threshold correction can be completed in a short period. Therefore, regarding the threshold correction, the final threshold correction may be performed for a short period as in the case of the first line in FIGS. 8 to 10, and the threshold correction can be appropriately completed in the respective pixel circuits 10 on each line.

In other words, as long as a sufficient threshold correction period is secured for one round of the threshold correction before the final threshold correction starts (or in the case of performing the threshold correction in three or more rounds, several rounds of the threshold correction before the final threshold correction starts), no problem will be caused even when the different threshold correction periods are provided for the final threshold correction in each pixel circuit 10 as in the case of the present embodiment.

Given the above, the gate-source voltages Vgs in each of the pixel circuits 10 illustrated in FIG. 10 will be substantially the same (Vgs1≈Vgs2≈Vgs3) at time stages immediately before the writing of the video signal voltage Vsig.

By doing so, thereafter, when the video signal voltages Vsig#1, Vsig#2, and Vsig#3 are written in periods t15 to t16, t17 to t18, and t19 to t20 (assuming Vsig#1=Vsig#2=Vsig#3), the current values will be the same in each line in the unit.

Therefore, it is possible to prevent shading in the unit as illustrated in FIG. 7 and realize constant uniformity.

According to the present embodiment, it is possible to prevent shading in the unit while taking advantage of the STC driving method from the perspective of securing the threshold correction period.

Therefore, it is possible to provide a display drive method capable of appropriately coping with the higher frame rate and the larger panel size.

While the embodiment has been described, the invention is not limited to the examples described above. For example, the number of rounds of the divided threshold correction operation in the STC driving is determined based on an actual frame rate and panel size and the like. For example, the threshold correction may be divided into three or more rounds and performed. The ending time points of the final round of the divided threshold correction may be set so that the waiting terms are the same in each pixel circuit 10.

If a sufficiently long period for one round of the threshold correction can be secured, and the threshold correction can be completed in the entire pixel circuits 10 in the unit by one round of the threshold correction operation, the divided threshold correction operation may not be performed. In that case, since the first round of the threshold correction is the final threshold correction, the ending time of the final threshold correction may be set so that the waiting terms WT are the same. In this case, it should be ensured that the threshold correction is completed in the pixel circuits 10 for which the threshold correction period becomes the shortest.

Moreover, the STC driving where three lines are grouped as one unit is an example, and the STC driving may be performed with four or more lines grouped as one unit.

The present application contains subject matter related to that disclosed in Japanese Priority Patent Application JP 2009-273236 filed in the Japan Patent Office on Dec. 1, 2009, the entire contents of which is hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A display apparatus comprising:

a pixel array including pixel circuits arranged in a matrix form, in which each pixel circuit has a light-emitting device, a drive transistor configured to apply a current corresponding to a gate-source voltage to the light-emitting device, a sampling transistor configured to input a voltage supplied from a signal line to a gate of the drive transistor when the sampling transistor is brought into a conduction state, and a storage capacitor connected between the gate and a source of the drive transistor so as to store a threshold voltage of the drive transistor and an input video signal voltage;

a signal selector configured to supply a reference voltage and the video signal voltage to each of signal lines arranged in a column on the pixel array; and a scanner configured to apply a pulse to each of control lines arranged in a row on the pixel array so as to control the sampling transistor, wherein the signal selector is configured to input the reference voltage to the signal lines so that a threshold correction operation starts simultaneously within one emission cycle period in the respective pixel circuits, input the video signal voltage sequentially to the signal lines after an ending time point of the threshold correction operation, and the scanner is configured to output the pulse to cause the ending time point of the threshold correction operation to occur at different times to each of the control lines so that periods from the ending time points of the threshold correction operation in the respective pixel circuits, at which time a first transition of the pulse from a first level to a second level occurs, to the start of the inputting of the video signal voltage, at which time a second transition of the pulse from the second level to the first level occurs, are the same, wherein the threshold correction operation sets a voltage across the storage capacitor connected between the gate and the source of the drive transistor equal to the threshold voltage of the drive transistor.

2. The display apparatus according to claim 1, wherein the scanner causes the threshold correction operation to be performed in several rounds within one emission cycle period in each pixel circuit and outputs the pulse that causes the ending time point of only a final round of the threshold correction operation among the several rounds of the threshold correction operation to occur at different times in each pixel circuit.

3. The display apparatus according to claim 2, wherein the scanner outputs the pulse that causes the ending time points of other rounds of the threshold correction operation other than the final round of the threshold correction operation among the several rounds of the threshold correction operation to occur simultaneously in each pixel circuit.

4. The display apparatus according to claim 1, wherein the reference voltage is supplied to the signal lines throughout the threshold correction operation.

5. A display drive method of a display apparatus including a pixel array including pixel circuits arranged in a matrix form, in which each pixel circuit has a light-emitting device, a drive transistor applying a current corresponding to a gate-source voltage to the light-emitting device, a sampling transistor inputting a voltage supplied from a signal line to a gate of the drive transistor when the sampling transistor is brought into a conduction state, and a storage capacitor connected between the gate and source of the drive transistor so as to store a threshold voltage of the drive transistor and an input video signal voltage a signal selector that supplies a reference voltage and the video signal voltage to each of signal lines arranged in a column on the pixel array, and a scanner that applies a pulse to each of control lines arranged in a row on the pixel array so as to control the sampling transistor, the method comprising:

inputting, by the signal selector, the reference voltage to the signal lines so that a threshold correction operation starts simultaneously within one emission cycle period in the respective pixel circuits, inputting, by the signal selector, the video signal voltage sequentially to the signal lines after an ending time point of the threshold correction operation, and outputting, by the scanner, the pulse to cause the ending time point of the threshold correction operation to occur at different times to each of the control lines so that periods from the ending time points of the threshold correction operation in the respective pixel circuits, at which time a first transition of the pulse from a first level to a second level occurs, to the start of the inputting of the video signal voltage, at which time a second transition of the pulse from the second level to the first level, occurs, are the same.

6. The display drive method according to claim 5, further comprising supplying the reference voltage to the signal lines throughout the threshold correction operation.

7. A display apparatus comprising:

a signal selector;

a scanner; and a pixel array that performs a threshold correction operation and a video signal write operation on pixel circuits in response to a pulse output from the scanner, wherein the signal selector is configured to start the threshold correction operation simultaneously in each of the pixel circuits on plural rows, apply the video signal to write operation to start sequentially in each of the pixel circuits on the plural rows, and the scanner is configured to output the pulse so that a period from the end of the threshold correction operation, at which time a first transition of the pulse from a first level to a second level occurs, to the start of the video signal write operation, at which time a second transition of the pulse from the second level to the first level occurs, is the same in each of control lines on the plural rows.

8. A display apparatus comprising:

a signal selector;

a scanner;

a signal line that supplies a reference potential and a video signal potential; and a pixel array that inputs the reference potential and the video signal potential from the signal line to pixel circuits in response to a pulse output from the scanner, wherein the signal selector is configured to input the reference potential simultaneously in each pixel circuit on plural rows, input the video signal potential sequentially in each pixel circuit on the plural rows, and the scanner is configured to output the pulse so that a period from the end of the inputting of the reference potential, at which time a first transition of the pulse from a first level to a second level occurs, to the start of the inputting of the video signal potential, at which time a second transition of the pulse from the second level to the first level occurs, is the same in each of control lines on the plural rows.

* * * * *